United States Patent [19]

Klaus

[11] Patent Number: 4,945,521

[45] Date of Patent: Jul. 31, 1990

[54] WATCH

[75] Inventor: Kurt Klaus, Schaffhausen, Switzerland

[73] Assignee: IWC International Watch Co. AG, Schaffhausen, Switzerland

[21] Appl. No.: 383,877

[22] Filed: Jul. 21, 1989

[30] Foreign Application Priority Data

Sep. 24, 1988 [DE] Fed. Rep. of Germany ..... 3832514

[51] Int. Cl.[5] ..... G04B 19/22; G04B 17/12

[52] U.S. Cl. ..... 368/21; 368/27; 368/185

[58] Field of Search ..... 368/21, 22, 27, 185, 368/186–199

[56] References Cited

U.S. PATENT DOCUMENTS

| | | | |
|---|---|---|---|
| 2,305,508 | 12/1942 | Woodruff | 368/21 |
| 3,785,141 | 1/1974 | Ikegami | 368/21 |
| 4,634,287 | 1/1987 | Vuilleumier et al. | 268/27 |

*Primary Examiner*—Bernard Roskoski
*Attorney, Agent, or Firm*—Martin A. Farber

[57] ABSTRACT

A watch has an hour wheel (17) which can be driven in rotation around an axis of rotation (10) by a drive, and has a rotatable universal-time hour wheel (13) arranged coaxially thereto. These two hour wheels are connected to each other by a spring-loaded detent connection. The universal-time hour wheel (13) is rotatably settable stepwise relative to the hour wheel (17) by a setting element. It overcomes the spring force of the detent connection, in which connection the setting element can be coupled to the universal-time hour wheel (13) for setting the latter and can be decoupled again after the setting. The hour wheel (17) is connected to an hour hand (2), and a universal-time hour hand (3) is connected to a universal-time hour wheel (13), by which means the times of two different time zones can be indicated on a stationary dial face. The setting element is a time-zone ring (8) which is arranged concentric to the axis of rotation (10), and can be rotatably set stepwise from detent position to detent position, and by which a transmission element for resetting the universal-time hour wheel (13) can be driven.

33 Claims, 11 Drawing Sheets

WATCH

FIELD AND BACKGROUND OF THE INVENTION

The present invention relates to a watch having an hour wheel which can be driven in rotation around an axis of rotation by a drive, and a rotatable universal-time hour wheel arranged coaxially thereto. The hour wheels are connected by a spring-loaded detent connection, having a setting element by which the universal-time hour wheel can be rotatably reset, stepwise relative to the hour wheel and overcoming the spring force of the detent connection. The setting element is adapted to be coupled to the universal-time hour wheel in order to reset the latter and to be decoupled from it after the setting. The watch has an hour hand connected to the hour wheel as well as a universal-time hour hand connected to the universal-time hour wheel, by which hands the times of two different time zones can be indicated on a fixed dial face.

In such so-called universal-time watches the hour hand indicates the time within the time zone in which the wearer of the watch usually lives. The universal-time hour hand, however, indicates the time in another of the total of 24 time zones of the world.

In order to be able to set the universal-time hour hand to a desired zone out of said 24 time zones relative to the hour hand, and to make it possible to drive the hour hand and the universal-time hour hand by a common drive, the two hands are connected to each other by a spring-loaded detent connection. By means of a setting element, a stepwise relative resetting of the two hands in hourly steps is possible by overcoming the spring force of the detent connection.

SUMMARY OF THE INVENTION

It is an object of the invention to create a watch of the type described which has a simply constructed setting mechanism consisting of only a few parts for setting the universal-time hour hand.

According to the invention, the setting element is a time-zone ring (8) which Is arranged concentric to the axis of rotation (10) and which can be rotatably reset stepwise from detent position to detent position and by which a transmission element for setting the universal-time hour wheel (13) can be driven. Only a few simply constructed parts are required in order to effect a resetting of the universal-time hour wheel and thus of the universal-time hour hand.

In one advantageous embodiment, the time-zone ring (8) has a gear rim with which there engages a transmission star wheel (12) the teeth of which, upon the turning of the time-zone ring (8) from one detent position to the next detent position, can be brought into engagement with the teeth of a universal-time gear wheel (20) rigidly attached to the universal-time hour wheel (13). The universal-time hour wheel (13) can be moved by one step from its position at the time relative to the hour wheel (17).

The time-zone ring (8) preferably has detent positions corresponding to the time zones uniformly distributed over its circumference twenty-four, and the universal-time hour wheel (13) can be displaced stepwise by an angle which corresponds to one hour, in which connection the universal-time hour wheel (13) can be displaced through an angle of 30 degrees per setting step.

For the simple driving of the time-zone ring, the time-zone ring (8) can be rotatably settable by a time-zone setting drive (28) which engages into the gear rim of the time-zone ring (8) and which can be rotatably driven manually by means of a crown.

An exact positioning and fixing of the time-zone ring in this position is obtained in the manner that a detent element (30) which is fixed in space can be moved radially under spring action into the tooth gaps (29) of the gear rim of the time-zone ring (8), and can rest against the facing tooth flanks of two adjacent teeth.

In order to tell the wearer of the watch also to which time zone the universal-time hour hand has been set, the time-zone ring (8) can be provided with a time-zone indicator ring which bears, distributed over its circumference, time-zone markings which are associated with the detent positions and which can be aligned with a stationary identification marking (9). The time-zone ring thus serves not only for the resetting but at the same time also for the indicating of the time zone set.

The gear rim of the time-zone ring (8) is preferably an inner gear rim (11).

If the time-zone ring (8) can be driven for rotation in any direction around the axis of rotation (10) then the shortest resetting path can always be for the setting of the desired time zone.

In order for the resetting mechanism of the universal-time hour wheel to be decoupled in its position of rest in simple manner from the hour wheel and the universal-time hour wheel which are continuously driven by the drive, a tooth gap of the transmission star wheel (12) can face, when the time-zone ring (8) is in a detent position. The gear wheel of the universal-time hour wheel (13), prevents contact of the transmission star wheel (12) with the universal-time gear wheel (20) of the universal-time hour wheel (13).

In one simple embodiment, the detent connection between the universal-time hour wheel (13) and the hour wheel (17) has a detent which is arranged on the hour wheel (17), and is radially moveable under spring action into detent recesses uniformly distributed over the circumference of the universal-time hour wheel (13).

In order to assure an exact positioning of the universal-time hour hand with respect to the hour hand, the detent can be so developed that it moves into a concentric position of rest in the detent recess.

This is obtained in simple manner by developing the detent in the region thereof extending into the detent recess as detent tooth (24) with ramp-like flanks (25) extending symmetrically in both directions of rotation.

The detent recesses can in this connection be tooth gaps (27) of the universal-time hour wheel (13) developed as gear wheel with preferably twelve teeth. The ramp-like flanks slide easily along the flanks of the tooth gap until the detent tooth rests with both flanks against the flanks of the tooth gap.

A small structural height is obtained in the manner that the universal-time hour wheel (13) and the universal-time gear wheel (20) rigidly connected thereto are arranged coaxially parallel alongside each other.

If the smallest possible guide angle with which the transmission star wheel (12) is in engagement with the universal-time gear wheel (20) has such a value that the tip of the detent tooth (24) can be moved out of the region of a tooth gap (27) into the immediately adjoining region of an adjacent tooth gap of the universal-time hour wheel (13), and if the largest possible guide angle with which the transmission star wheel is in engagement with the universal-time gear wheel (20) has such a value that the tip of the detent tooth (24) can be moved out of the region of a tooth gap (24) into the region furthest away from the latter of an adjacent tooth gap of the universal-time hour wheel (13), then a dependable advancing of the universal-time hour wheel by one detent position always takes place independently of the position at the time of the teeth of the universal-time gear wheel.

The universal-time gear wheel (20) preferably has twenty-four teeth.

The universal-time hour hand (3) can be driven in rotation with two revolutions per twenty-four hours.

If, in addition to the normal dial of the dial face, there can be rotatably driven by the universal-time hour wheel (13) a 24-hour indication which is arranged concentric to the axis of rotation (19), has an annular scale (7) bearing 24-hour markings and is associated with a stationary marking, then the time can be read off from said annular scale in 24-hour divisions of the day.

As a double function, the stationary marking can in this connection, be the identification marking (9).

The annular scale (7) can be provided with values which increase in the direction of rotation of the universal-time hour hand (3) and can be rotatably driveable in direction opposite the direction of rotation of the universal-time hour hand (3) with half the speed of rotation of the universal-time hour hand (3).

For the driving of the 24-hour indication, the 24-hour indication can be rigidly connected to a 24-hour indicator wheel (34) which is rotatable around the axis of rotation (10), is developed as a gear wheel and can be driven via a step-down gear ring (14) by the universal-time gear wheel (20), the drive train from the universal-time gear wheel (20) to the 24-hour indicator wheel (34) being inseparable. In this way, no additional drive is required for the 24-hour indication.

In order to make resetting of the universal-time hour hand with respect to the hour hand possible without the time-zone ring also being reset thereby, the universal-time hour wheel (13) can, with the setting element decoupled, be rotatably displaceable stepwise with respect to the hour wheel (17), overcoming the spring force of the detent connection by a correcting setting device. In this way, each time zone of the watch can be set as the time zone in which the wearer of the watch usually resides.

Impairment of the normal drive of the watch is avoided in the manner that the correction setting device can be coupled, for the correcting resetting of the universal-time hour wheel (13), to the latter and can be decoupled after the correction resetting.

A displacement of the universal-time hour wheel is possible in the manner that the correction setting device (15) can rotatably drive a gear wheel of the drive train from the universal-time gear wheel (20) to the 24-hour indicating wheel, in which case the gear wheel can be an intermediate gear (32) of the step-down gearing (14).

A simple development as well as simple actuation are obtained in the manner that the correction setting device (15) has a pusher (16) which can be displaced longitudinally by hand and by which a switch pin (37) can be moved against spring force out of an unengaged position of rest and engaged into the gear wheel of the drive train, rotating it in such a manner that the universal-time hour wheel (13) can be rotated by one setting step relative to the hour wheel (17).

If the smallest possible guide angle with which the switch pin (37) is in engagement with the gear wheel has such a value that the tip of the tooth of the gear wheel (24) can be moved out of the region of a tooth gap (27) into the directly adjoining region of an adjacent tooth gap of the hour wheel (13), and the largest possible guide angle with which the switch pin (37) is in engagement with the gear wheel has such a value that the tip of the detent tooth (24) can be moved out o( the region of a tooth gap (27) into the region furthest away therefrom of an adjacent tooth gap of the universal-time hour wheel (13), then a dependable advancing of the universal-time hour hand by one detent position takes place in all cases independently of the position at the time of the teeth of the universal-time gear wheel.

In one simple embodiment, the switch pin (37) is arranged on a swing lever (33) which can be swung by the pusher (16) around a correcting swivel axis.

In order to make a re turn of the switch pin into its position of rest possible without any contact with, and thus impairment of, the gear wheel taking place thereby, the swing lever (33) can be so guided that it can be moved back into the unengaged position of rest after a correction resetting in such a manner that the switch pin (37) moves over a path of movement outside the gear wheel. This is achieved in simple manner by the swing lever (33) being displaceable by spring force into a setting position after a correction setting and being swingable into the unengaged position of rest around a resetting swivel axis, the distance of the unengaged position of rest from the switch pin being less than the distance between the correction axis and the switch pin (37).

BRIEF DESCRIPTION OF THE DRAWING

With the above and other objects and advantages in view, the present invention will become more clearly understood in connection with the detailed description of preferred embodiments, when considered with the accompanying drawing, of which.

DETAILED DESCRIPTION OF THE PREFERRED EMBODIMENT

Figure 1:
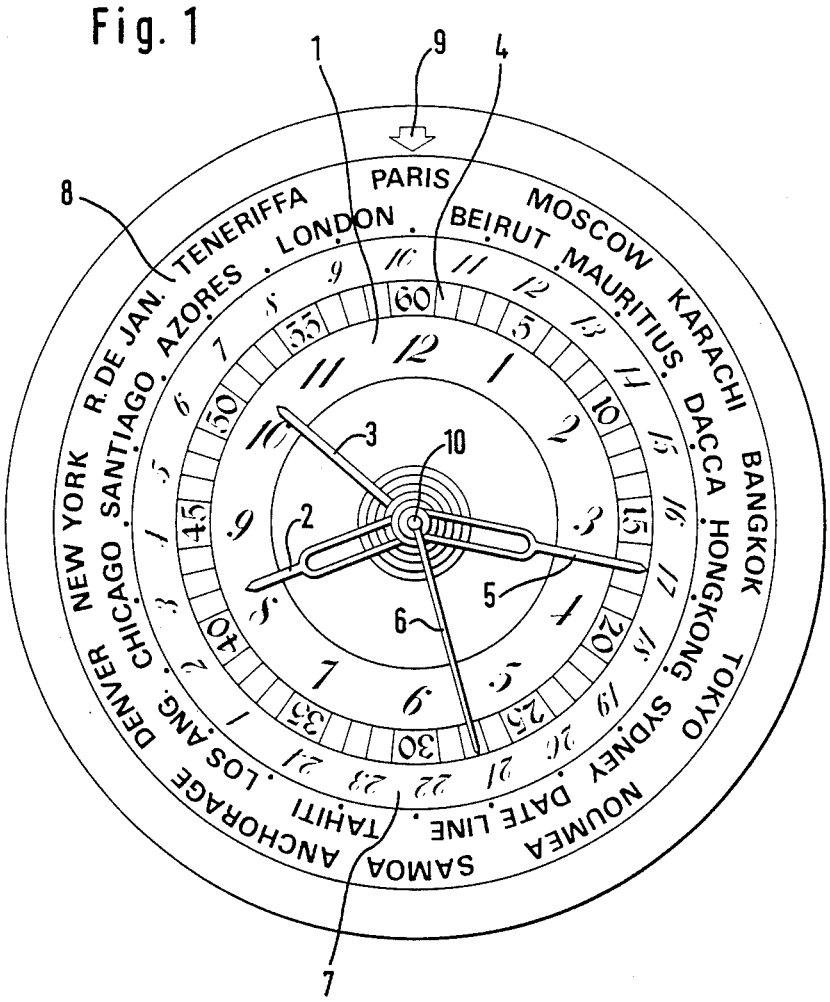
FIG. 1 is a view of the dial face of a watch.

The dial face shown in FIG. 1 has a stationary annular inner hour scale 1 with twelve hour markings which are moved over by an hour hand 2 and a universal-time hour hand 3 The hour scale 1 is surrounded by a minute scale 4, also stationary, which is swept over by both a minute hand 5 and a second hand 6. A rotatably driveable annular scale 7 of a 24-four hour indication with twenty-four hour markings surrounds the minute scale 4.

The annular scale 7 is surrounded by a time-zone ring 8, which is also arranged in rotatable manner, and which is provided with twenty-four uniformly distributed names of cities which are the symbols of the twenty-four different time zones.

A stationary identification marking 9 developed as arrow is arranged radially outside the time-zone ring 8 and is associated both with the time-zone ring 8 and with the annular scale 7. All scales and rings are arranged concentric to an axis of rotation 10 around which the hands are also arranged for rotation.

Figure 2:
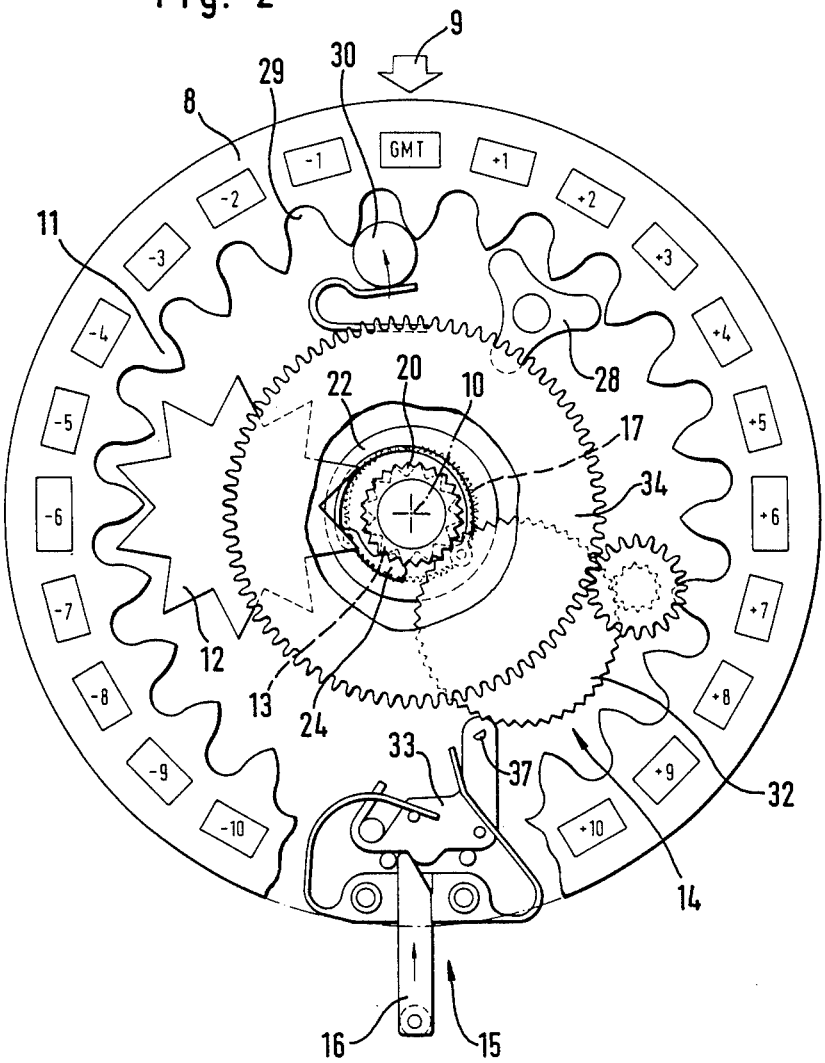
FIG. 2; is a view of the time-zone mechanism and the 24-hour indicating mechanism of the watch of FIG. 1, shown in position of rest.

FIG. 2 shows an inner gear rim 11 which is rigidly connected to the time-zone ring 8. The cities of the time-zone ring 8 are arranged on the inner gear rim 11, corresponding to twenty-four markings. Via a transmission star wheel 12, the inner gear rim 11 can drive a universal-time hour wheel 13 in rotation. Furthermore, a 24-hour indication (not shown) together with the annular scale 7 can be driven in rotation by the universal-time hour wheel 13 via a drive train which has a step-down gearing 14. A correcting setting device 15 engages into the drive train and can be actuated by a pusher 16. A more detailed description of the individual sub-assemblies shown in FIG. 2 will be given with reference to the following figures.

Figure 3:
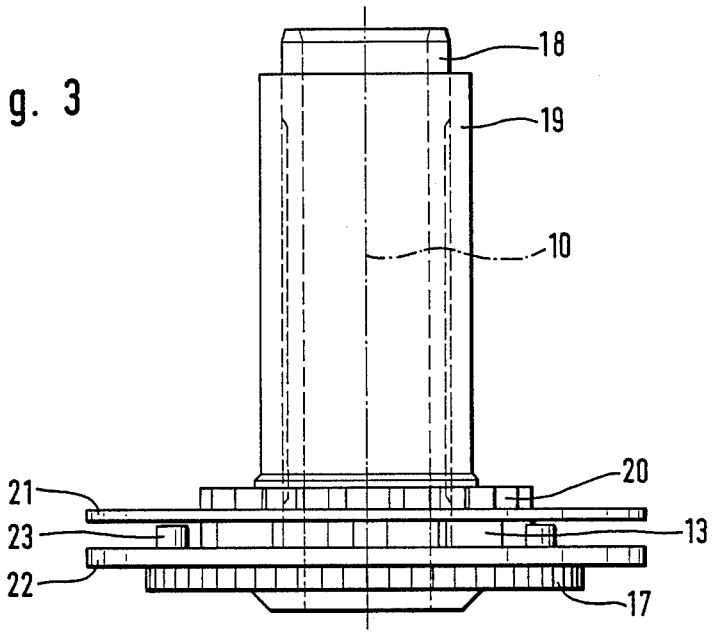
FIG. 3 is a side view of the sub-assembly consisting of universal-time hour wheel and hour wheel of FIG. 1.
Figure 4:
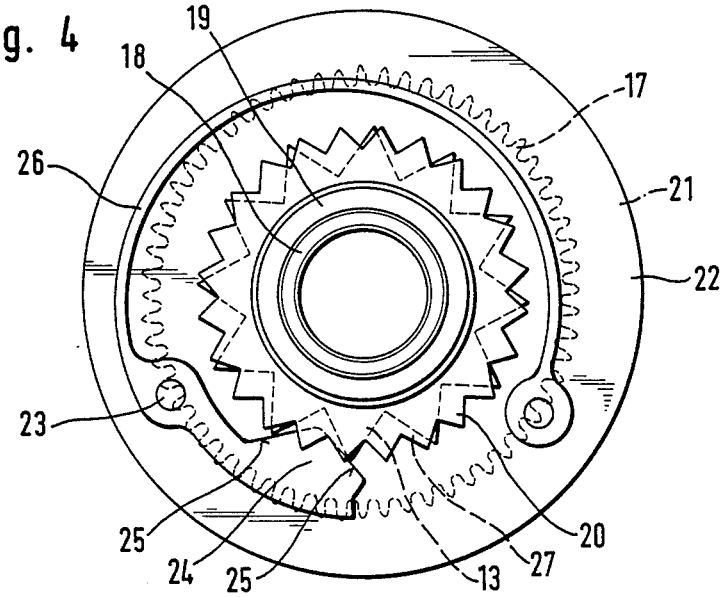
FIG. 4 is a top view of the sub-assembly of FIG. 3.

In FIGS. 3 and 4, an hour wheel 17 and the universal-time hour wheel 13 are mounted for rotation around the axis 10. The hour wheel 17 has an hour pinion 18 on which the universal-time hour wheel 13 and a universal-time hour tube 19 are mounted for rotation. The hour hand 2 can be attached to the hour tube 18 and the universal-time hour hand 3 to the universal-time hour tube 19.

The minute and second tubes which bear the minute hand 5 and the second hand 6, respectively and pass coaxially through the hour tube 18 are not shown.

A 24-tooth universal-time gear wheel 20 is arranged alongside and parallel to the 12-tooth universal-time hour wheel 13, the universal-time gear wheel 20 being firmly attached to the universal-time hour tube 19. An intermediate disk 21 is arranged between the universal-time hour wheel 13 and the universal-time gear wheel 20.

An hour wheel disk 22 which is firmly attached to the hour tube 18 and bears a detent tooth 24 which is swingable around a shaft 23 is arranged axially alongside the universal-time hour wheel 13.

The detent tooth 24 has ramp-like flanks 25 which extend symmetrically in both directions of rotation, and by which it can be moved radially into the tooth gaps 27 of the universal-time hour wheel 13 which is developed with twelve teeth. The detent tooth 24 is provided with a spring arm 26 which rests under initial stress against the hour wheel disk 22 and urges the detent tooth 24 under spring action into the tooth gap 27. Upon its movement into the tooth gap 27, the flanks 25 of the detent tooth 24 slide along the flanks of the tooth gap 27 until the detent tooth 24 extends centrally into the tooth gap 27, resting against both tooth flanks of the latter.

The detent tooth 24 which has engaged into the tooth gap 27 forms a detent connection between the universal-time hour wheel 13 and the hour wheel 17 which is driven by a drive (not shown) at two revolutions per twenty-four hours. By the action of force, the universal-time hour wheel 13 can be turned relative to the hour wheel 17. In such case, the detent tooth 24 is pulled out of its tooth gap 27 and engages again into the adjacent tooth gap. In this way, the universal-time hour hand 3 is shifted one hour with respect to the hour hand 2 The identification marking 9 then points to that city the time zone of which now corresponds to the time indicated by the universal-time hour hand 3.

Figure 5:
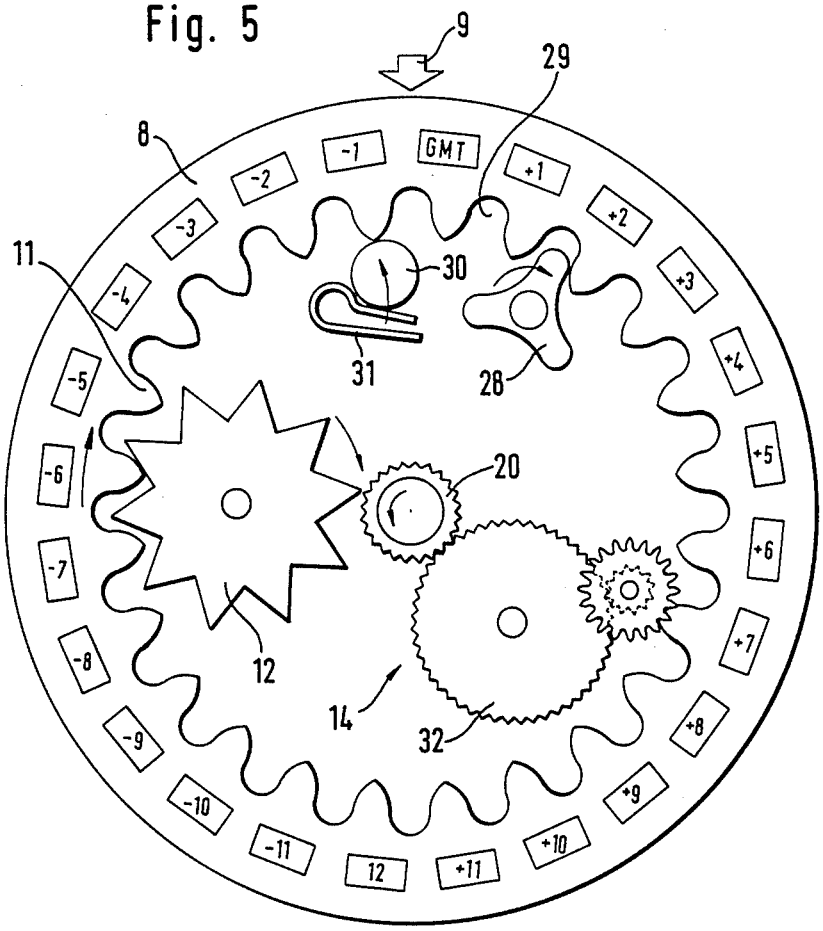
FIG. 5 is the view of FIG. 2, in presetting position of the time-zone rings.

Such a shifting of the universal-time hour hand 3 by one hour with respect to the hour hand 2 takes place due to the fact that the gear wheel of a time-zone setting drive 28 is so turned by means of a crown (not shown) that a stationary detent element 30, which is urged radially by a spring 31 into one of the twenty-four tooth gaps 29 of the inner gear rim 11 of the time-zone ring 8, is pushed out of its tooth gap 29 and engages again into the tooth gap adjacent thereto (FIG. 5). In this way, the transmission star wheel 12, the teeth of which engage into the tooth gaps 29 of the inner gear rim 11, is simultaneously turned by the inner gear rim.

Figure 6:
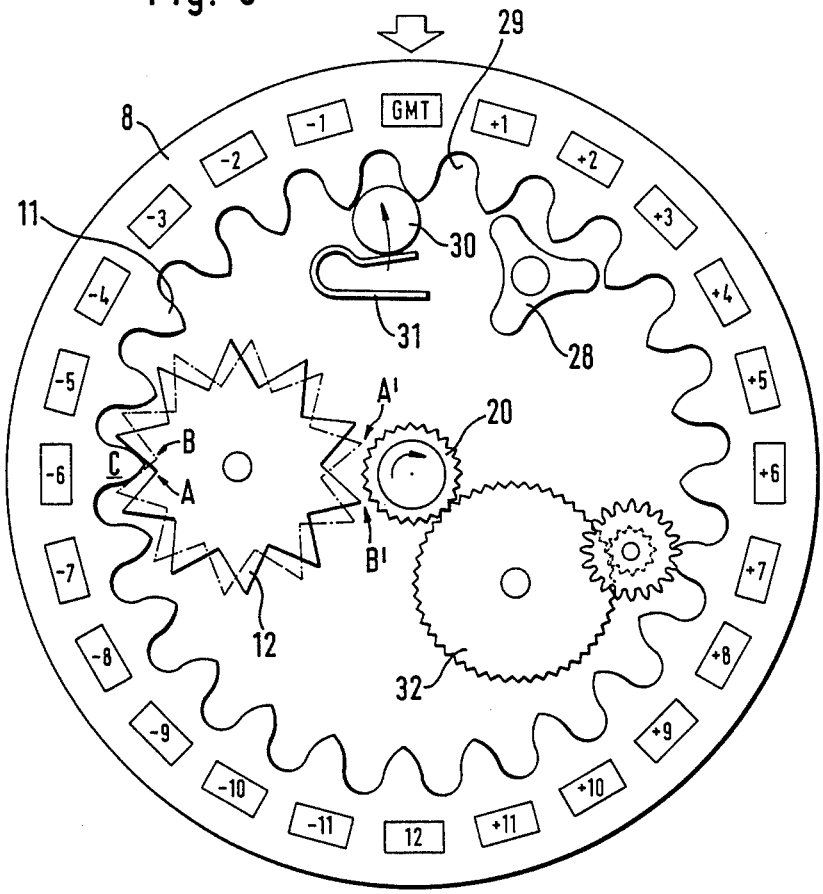
FIG. 6 is a view of FIG. 2, in position of rest, showing the end positions of the transmission star wheel.

As shown in FIG. 6, the clearance for movement of the transmission star wheel 12 relative to the inner gear rim 11 when the detent element 30 is engaged is such that no contacting of the universal-time gear wheel 20 by the transmission star wheel 12 is possible.

Upon turning the time-zone ring 8, however, one tooth of the transmission star wheel 12 comes into engagement with the universal-time gear wheel 20 and turns the latter, and thereby also the universal-time hour wheel 13, to such an extent that the detent tooth 24 is lifted out of its tooth gap 27 and comes into the region of the adjacent tooth gap into which it engages.

Figure 7:
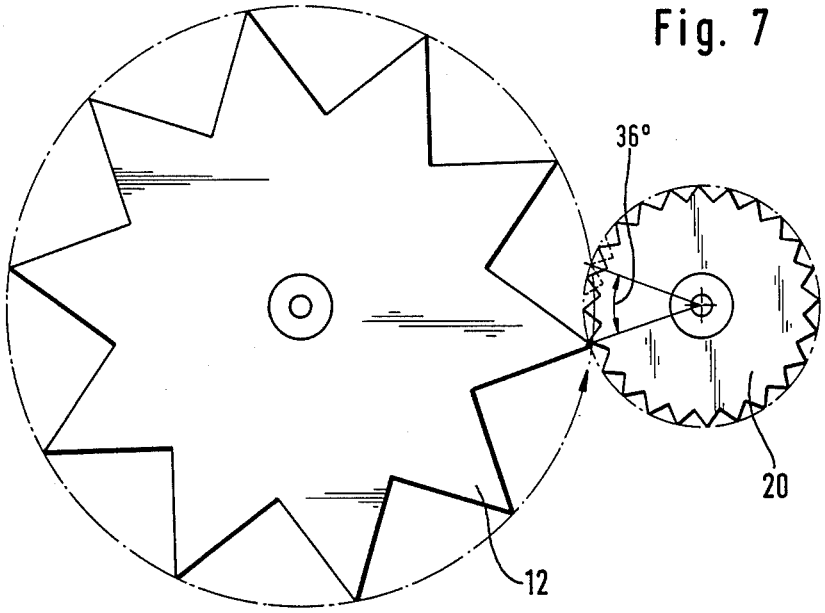
FIG. 7 is a view of the transmission star wheel and of the universal-time gear wheel of FIG. 2, in the position of the largest possible guide angle.
Figure 8:
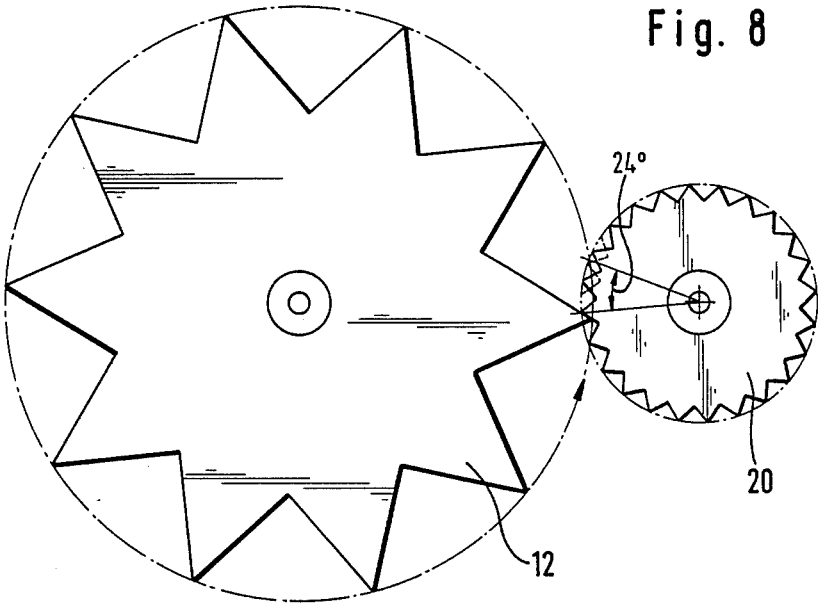
FIG. 8 is a view of the transmission star wheel and universal-time gear wheel of FIG. 2, in the position of the smallest possible guide angle.

Since the universal-time gear wheel 20 is continuously moved by the drive of the watch via the hour wheel 17 attached to it, the teeth of the universal-time gear wheel 20 can be in a different position with respect to the teeth of the transmission star wheel 12. Depending on this position, an engagement of the transmission star wheel 12 into the universal-time gear wheel 20 therefore takes place between a largest possible guide angle (FIG. 7) and a smallest possible guide angle (FIG. 8).

Upon engagement with the largest possible guide angle, the universal-time gear wheel 20 is turned to such an extent that the detent tooth 24 moves out of its tooth gap 27 at the time until the tip of its tooth is located in the region of the adjacent tooth gap of the universal-time hour wheel 13 which is furthest away from said tooth gap 27.

Upon engagement with the smallest possible angle, the universal-time gear wheel 20 is moved to such an extent that the detent tooth 24 moves out of its tooth gap 27 at the time until the tip of its tooth is located in that region of the adjacent tooth gap of the universal-time hour wheel 13 which directly adjoins said tooth gap 27.

Since the detent tooth 24 is urged by spring force into the new tooth gap, it strives, after disengagement of transmission star wheel 12 and universal-time gear wheel 20, to achieve, by sliding with its flanks 25 on the flanks of the new tooth gap, the central position in this tooth gap, so that a correct positional relationship between hour wheel 17 and universal-time hour wheel 13 is again present. The universal-time hour wheel 13 has thus been turned exactly one hour with respect to the hour wheel 17. Depending on the direction of rotation of the time-zone setting drive 28, this resetting has taken place forward or backward.

Figure 9:
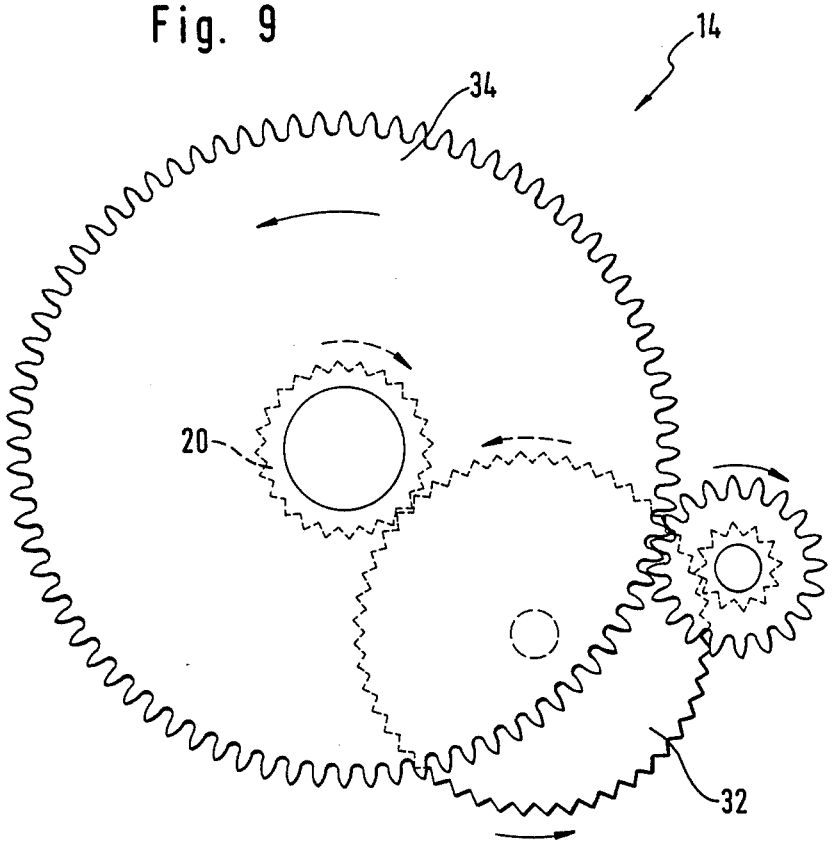
FIG. 9 is a view of the drive train from the universal-time gear wheel to the 24-hour indicating wheel of FIG. 2.

As shown in FIG. 9, an intermediate wheel 32 of the step-down gearing 14 also engages into the 24-tooth universal-time gear wheel 20. Driving in rotation of a 24-hour indicator wheel 34 having eighty teeth takes place via the step-down gearing. The step-down gearing 14 is of such a nature that the 24-hour indicator wheel 34 is driven counterclockwise by the universal-time gear wheel 20 with one turn per twenty-four hours. A decoupling of the drive train from the universal-time gear wheel 20 to the 24-hour indicator wheel 33 is not possible, so that continuous driving of the 24-hour indicator wheel 34 by the drive of the watch takes place.

The annular scale 7, which is provided with 24-hour markings, is firmly attached to the 24-hour indicator wheel 34. The identification marking 9 always points to the hour marking on the annular scale 7 that corresponds to the time indicated by the universal-time hour hand 3 on the hour scale 1. However, since the annular scale 7 bears 24-hour markings, one can immediately determine here whether the time is before noon or afternoon.

FIGS. 10 to 14 show a correction setting device 15 which can be brought into engagement with the intermediate wheel 32 of the step-down gearing 14 and by which the universal-time hour wheel 13 can be turned, overcoming the detent connection, with respect to the hour wheel 17. This is necessary in order to set the watch for a given time zone which is to be that time zone in which the wearer of the watch normally lives. For this purpose, the universal-time hour hand 3 is aligned with the hour hand 2 by means of the correction setting device 15, in which case the time-zone ring 8 must be in such a position that the identification marking 9 indicates the time zone in which the wearer of the watch normally lives.

After this calibration, the watch can be adjusted by means of the time-zone setting drive 28 for any other time zone, the time of which will then be indicated by the universal-time hour hand 3 while the hour hand 2 indicates the time in the time zone in which the wearer of the watch normally lives.

Figure 10:
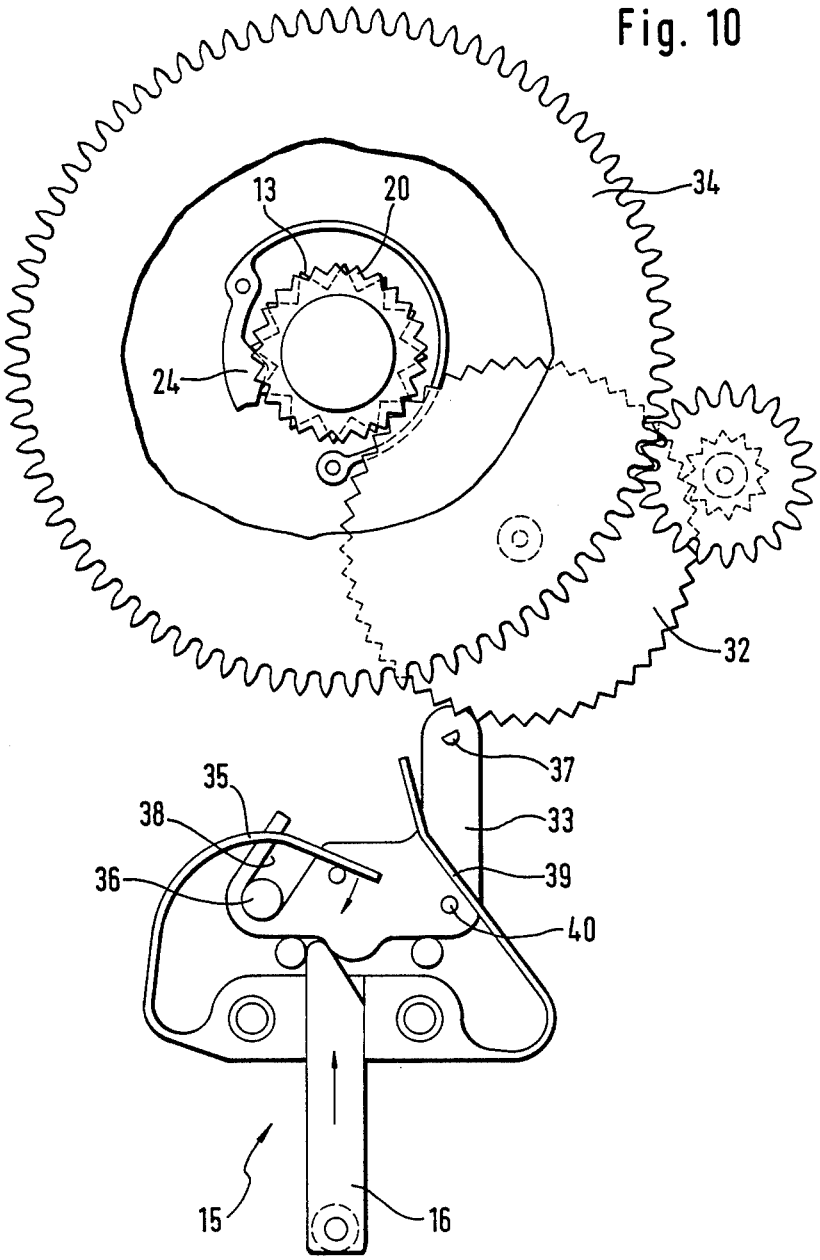
FIG. 10 is the drive train of FIG. 9 with a correction setting device, in position of rest.
Figure 11:
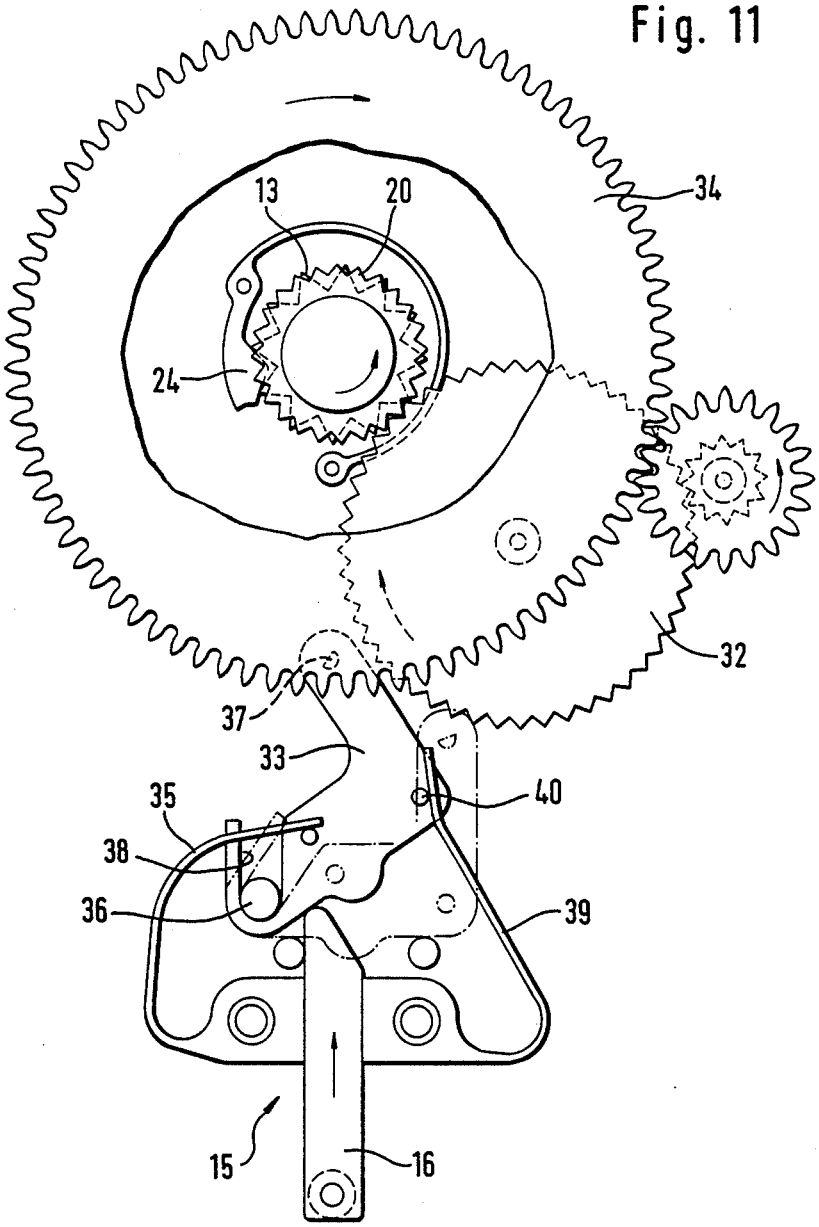
FIG. 11 is the drive train of FIG. 9 with the correction setting device, in resetting position.
Figure 12:
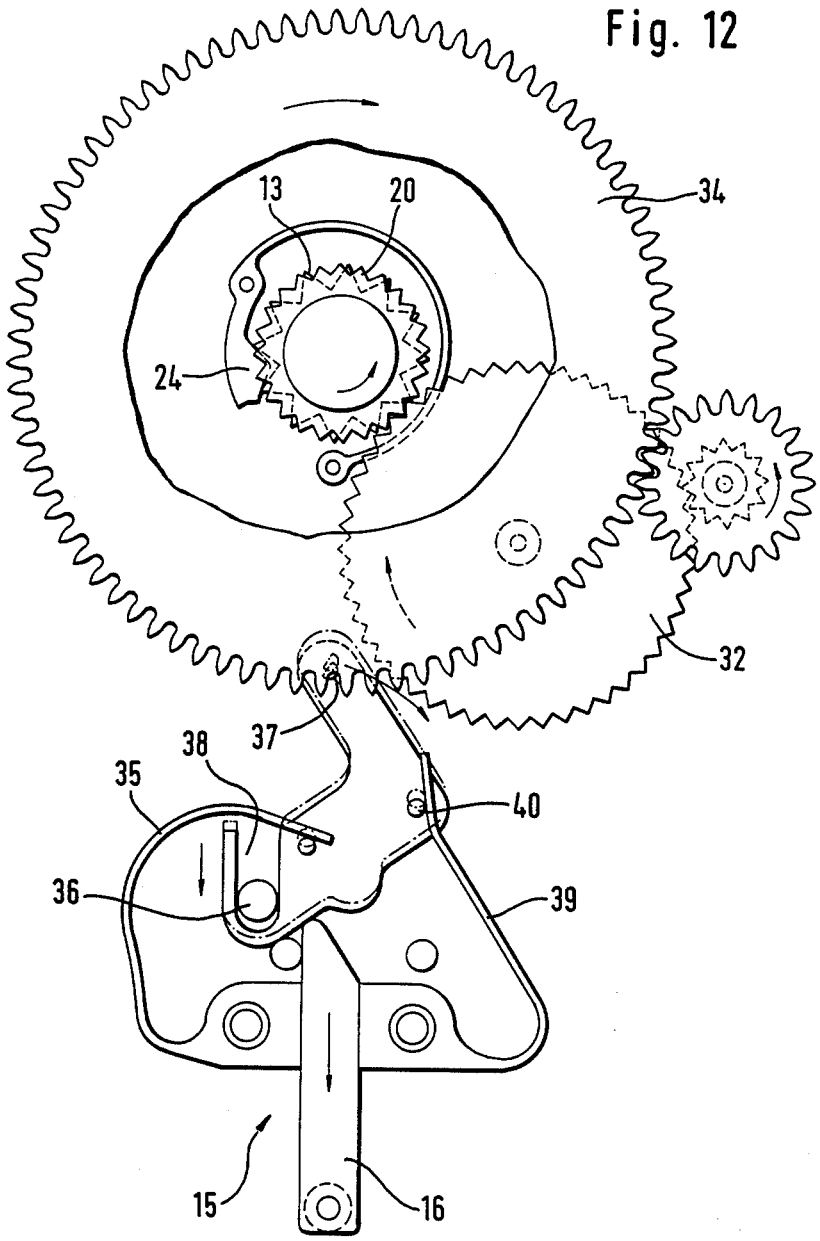
FIG. 12 is the drive train of FIG. 2, with the correction setting device in an intermediate position between the resetting position and the position of rest.
Figure 13:
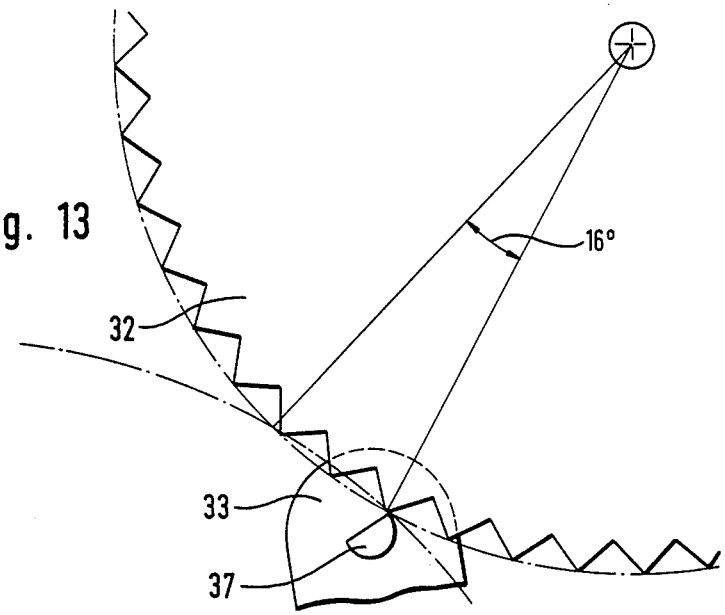
FIG. 13 is a view of the intermediate wheel and switch pin of FIG. 2 in the position of the largest possible guide angle.
Figure 14:
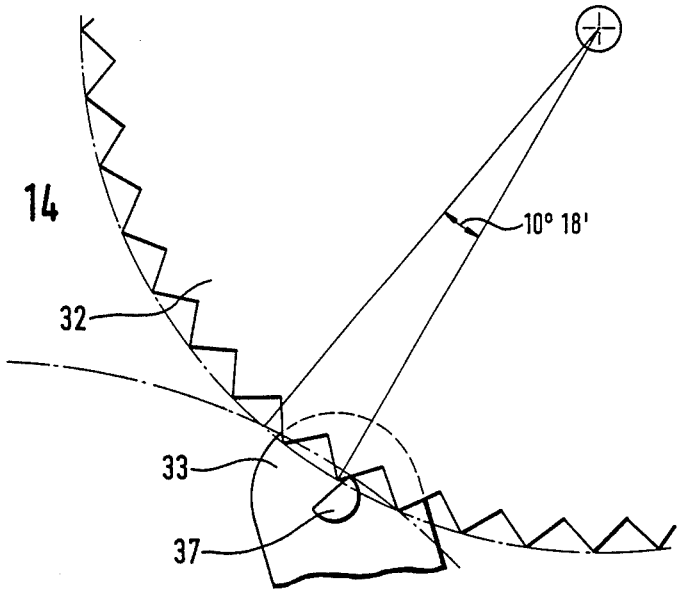
FIG. 14 is a view of the intermediate wheel and switch pin of FIG. 2, in the position of the smallest possible guide angle.

The correction setting device 15 is provided with the pusher 16 which can be manually displaced radial to the rotating shaft 10 and which is moveable against the force of a spring 35 acting on a swing lever 33, swinging the latter into the resetting position (FIG. 10). Upon movement out of a disengaged position of rest into the resetting position, the swing lever 33 can be swung around a correcting swivel axis, which is formed by a fixed pivot pin 36 which extends through a slot 38 in the swing lever 33. By acting on the swing lever 33 by means of the pusher 16, the end which bears a switch pin 37 and which is opposite the pivot pin 36 is swung in such a manner that the switch pin 37 comes into approximately tangential engagement with the intermediate wheel 32, drives the latter along over a certain distance and turns it before it is disengaged again from the intermediate wheel 32 and reaches its maximum deflection (FIG. 11).

Upon the subsequent movement of the swing lever out of the maximum deflection into the disengaged position of rest (FIG. 12), the spring 35 first of all displaces the swing lever 33 in such a manner that the pivot pin 36 assumes a different position in the slot 38 and now forms a restoring swivel axis, the distance of which from the switch pin 37 is less than the distance of the correction axis from the switch pin 37.

During this movement of the swing lever 33 out of the maximum deflection into the disengaged position of rest, the swing lever 33 is acted on, in addition, by a guide spring 39 in the direction of disengagement of the switch pin 37 from the intermediate wheel 32. The guide spring 39, which is developed as leaf spring, rests in this connection against a stop pin 40 of the swing lever 33 which slides along the guide spring 39 during the restoring movement.

Due to the displacement of the swing lever 33 and the actuation and guiding by the guide spring 39, the switch pin 37 moves from the maximum deflection into the disengaged position of rest on a path of movement outside the intermediate wheel 32.

Shortly before reaching the disengaged position of rest, the swing lever 33 is also again displaced by the spring 35 into the position in which the pivot pin 36 again forms the correction swivel axis.

Since the intermediate wheel 32 turns continuously, the position of its teeth with respect to the switch pin 37 is different. As a result thereof, the intermediate wheel 32 is displaced by the switch pin 37 between a smallest possible guide angle and a largest possible guide angle in which the switch pin 37 is in engagement with the intermediate wheel 32.

The largest possible guide angle (FIG. 13) has, in this connection, such a value that the tip of the detent tooth 24 can be moved out of the region of a tooth gap 27 into the region of a tooth gap of the universal-time hour wheel 13 adjacent thereto which is furthest away from said tooth gap 27. The smallest possible guide angle (FIG. 14) has such a value that the tip of the detent tooth 24 can be moved out of the region of a tooth gap 27 into the region of a tooth gap of the universal-time hour wheel 13 adjacent thereto which directly adjoins the tooth gap 27. A subsequent alignment of the universal-time hour wheel 13 with respect to the hour wheel 17 takes place by the detent tooth 24 in the manner already described.

I claim:

1. A watch comprising a drive, a spring loaded detent connection, and a setting element;

an hour wheel rotatable about an axis of rotation by the drive;

a rotatable universal-time hour wheel arranged coaxially to the hour wheel, each of the hour wheels being connected by the spring-loaded detent connection, the universal-time hour wheel being rotatably reset by the setting element stepwise relative to the hour wheel by overcoming a spring force of the detent connection;

a coupling means for coupling the setting element to the universal-time hour wheel in order to reset the latter and for decoupling the resetting element from the universal-time hour wheel after a setting of the universal-time hour wheel;

an hour hand connected to the hour wheel;

a universal-time hour hand connected to the universal-time hour wheel, the hands providing that the times of two different time zones can be indicated on a fixed dial face;

a transmission element for setting the universal-time hour wheel; and wherein the setting element is a time-zone ring which is arranged concentric to the axis of rotation and which can be rotatably reset stepwise from detent position to detent position; and the transmission element for setting the universal-time hour wheel can be driven by the time-zone ring.

2. A watch according to claim 1, further comprising a transmission star wheel having teeth;

a universal-time gear wheel having teeth and being rigidly attached to the universal-time hour wheel; and wherein said time-zone ring has a gear rim which engages with the transmission star wheel the teeth of which, upon a turning of the time-zone ring from one detent position to the next detent position, is brought into engagement with the teeth of the universal-time gear wheel; and the universal-time hour wheel is moveable by one step at a time relative to the hour wheel (17).

3. A watch according to claim 1, wherein said time-zone ring has detent positions, corresponding to time zones, uniformly distributed over its circumference; and said universal-time hour wheel is displacable stepwise by an angle which corresponds to one hour.

4. A watch according to claim 1, wherein said universal-time hour wheel is displacable through an angle of 30 degrees per setting step.

5. A watch according to claim 2, further comprising a time-zone setting drive, and a crown; and wherein said time-zone ring is rotatably settable by the time-zone setting drive which engages into the gear rim of the time-zone ring, the time-zone setting drive being rotatably driven manually by means of the crown.

6. A watch according to claim 2, further comprising a detent element which is moveable radially under spring action into tooth gaps of the gear rim of said time-zone ring, and then rests against facing tooth flanks of two adjacent teeth of the gear rim of said time-zone ring.

7. A watch according to claim 1, wherein the time-zone ring is provided with a time-zone indicator ring which bears, distributed over its circumference, time-zone markings which are associated with the detent positions and which can be aligned with a stationary identification marking.

8. A watch according to claim 2, wherein the gear rim of the time-zone ring is an inner gear rim.

9. A watch according to claim 1, wherein the time-zone ring is drivable for rotation in any direction around the axis of rotation

10. A watch according claim 2, wherein a tooth gap of the transmission star wheel faces, when the time-zone ring is in a detent position, the universal-time gear wheel to prevent contact of the transmission star wheel with the universal-time gear wheel.

11. A watch according to claim 2, wherein the universal-time hour wheel has detent recesses uniformly distributed over the circumference of the universal-time hour wheel;

the detent connection between the universal-time hour wheel and the hour wheel has a detent which is arranged on the hour wheel and is radially moveable under spring action into the detent recesses uniformly distributed over the circumference of the universal-time hour wheel.

12. A watch according to claim 11, wherein the detent is developed such that it moves into a concentric position of rest in a detent recess.

13. A watch according to claim 12, wherein said detent in the region thereof extending into the detent recess is formed as a detent tooth with ramp-like flanks extending symmetrically in both directions of rotation.

14. A watch according to claim 11, wherein the detent recesses are formed as tooth gaps of the universal-time hour wheel, the latter being a gear wheel.

15. A watch according to claim 14, wherein the universal-time hour wheel has twelve teeth.

16. A watch according to claim 2, wherein the universal-time hour wheel and the universal-time gear wheel rigidly connected thereto are arranged coaxially parallel alongside each other.

17. A watch according to claim 13, wherein the smallest possible guide angle with which the transmission star wheel is in engagement with the universal-time gear wheel has such a value that the tip of the detent tooth can be moved out of the region of a tooth gap into the immediately adjoining region of an adjacent tooth gap of the universal-time hour wheel, and the largest possible guide angle with which the transmission star wheel is in engagement with the universal-time gear wheel has such a value that the tip of the detent tooth can be moved out of the region of a tooth gap into the region furthest away from the latter of an adjacent tooth gap of the universal-time hour wheel.

18. A watch according to claim 2, wherein the universal-time gear wheel has twenty-four teeth.

19. A watch according to claim 1, wherein the universal-time hour hand is drivable in rotation with two revolutions per twenty-four hours.

20. A watch according to claim 13, further comprising a 24-hour indication; and wherein the universal-time hour wheel drives the 24-hour indication which is arranged concentric to the axis of rotation, has an annular scale bearing 24-hour markings, and is associated with a stationary marking.

21. A watch according to claim 20, wherein the stationary marking is the identification marking.

22. A watch according to claim 21, wherein the time-zone ring is provided with a time-zone indicator ring which bears, distributed over its circumference, time-zone markings which are associated with the detent positions and which can be aligned with a stationary identification marking.

23. A watch according to claim 20, wherein the annular scale is provided with values which increase in the direction of rotation of the universal-time hour hand, and can be rotatably driveable in a direction opposite to the direction of rotation of the universal-time hour hand with half the speed of rotation of the universal-time hour hand.

24. A watch according to claim 20, further comprising a 24-hour indicator wheel which is rotatable about the axis of rotation;

a step-down gear ring; and wherein the 24-hour indication is rigidly connected to the 24-hour indicator wheel, is developed as a gear wheel and is driven via the step-down gear ring by the universal-time gear wheel, thereby forming a drive train from the universal-time gear wheel to the 24-hour indicator wheel, the drive train being inseparable.

25. A watch according to claim 25, wherein the universal-time hour wheel, with the setting element decoupled, is displaceable rotatably stepwise with respect to the hour wheel, overcoming the spring force of the detent connection by a correction with said setting device.

26. A watch according to claim 25, wherein the setting device is coupled, for the corrective resetting of the universal-time hour wheel, to the latter and can be decoupled after a correction resetting.

27. A watch according to claim 24, wherein the corrective setting device rotatably drives a gear wheel of the drive train from the universal-time gear wheel to the 24-hour indicating wheel.

28. A watch according to claim 25, wherein the drive train has step-down gearing; and the gear wheel is an intermediate gear of the step-down gearing.

29. A watch according to claim 25, wherein the correction setting device comprises a pusher which is displacable longitudinally by hand; and a switch pin which is movable by the pusher against spring force out of an unengaged position of rest and engaged into the gear wheel of the drive train, rotating the gear wheel in such a manner that the universal-time hour wheel is rotated by one setting step relative to the hour wheel.

30. A watch according to claim 29, wherein the smallest possible guide angle with which the switch pin is in engagement with the gear wheel has such a value that the tip of a tooth of the gear wheel is movable out of the region of a tooth gap into a directly adjoining region of an adjacent tooth gap of the hour wheel; and the largest possible guide angle with which the switch pin is in engagement with the gear wheel has such a value that the tip of the detent tooth is movable out of the region of a tooth gap into the region furthest away therefrom of an adjacent tooth gap of the universal-time hour wheel.

31. A watch according to claim 30, wherein the correction setting device comprises a swing lever; and wherein the switch pin is arranged on the swing lever, the swing lever being pivotable by the pusher around a correction swivel axis.

32. A watch according to claim 31, wherein the swing lever is guided for movement back into an unengaged position of rest after correction resetting in such a manner that the switch pin moves over a path of movement outside the gear wheel.

33. A watch according to claim 32, wherein the swing lever is displaceable by spring force into a setting position after a correction setting, and is pivotable into the unengaged position of rest around a resetting swivel axis, the distance of the unengaged position of rest from the switch pin being less than the distance between the correction axis and the switch pin.

* * * * *